United States Patent [19]

Todd

[11] Patent Number: 4,635,846

[45] Date of Patent: Jan. 13, 1987

[54] INSULATIVE PROTECTIVE DEVICE FOR RAIL FASTENER

[75] Inventor: Peter L. Todd, Berkeley, Calif.

[73] Assignee: San Francisco Bay Area Rapid Transit District, Oakland, Calif.

[21] Appl. No.: 735,630

[22] Filed: May 20, 1985

[51] Int. Cl.[4] ..... E01B 9/38; E01B 11/54

[52] U.S. Cl. ..... 238/264; 238/338; 238/152

[58] Field of Search ..... 238/338, 154, 155–161, 238/307, 152, 264, 265, 283

[56] References Cited

U.S. PATENT DOCUMENTS

| | | | |
|---|---|---|---|
| 833,020 | 10/1906 | Bossert | 238/154 |
| 846,901 | 3/1907 | Bossert | 238/154 |
| 1,749,857 | 3/1930 | Thompson | 238/155 |
| 1,911,238 | 5/1933 | Pelkie | 238/154 |
| 2,670,136 | 2/1954 | Moses | 238/160 X |

FOREIGN PATENT DOCUMENTS

| | | | |
|---|---|---|---|
| 2421092 | 11/1975 | Fed. Rep. of Germany | 238/154 |
| 564484 | 12/1923 | France | 238/157 |

*Primary Examiner*—Robert B. Reeves
*Assistant Examiner*—Glenn B. Foster
*Attorney, Agent, or Firm*—Owen, Wickersham & Erickson

[57] ABSTRACT

A rail-support insulating device for electrically insulating rapid transit system rail apparatus from the rail support structure is described. The device includes a layer of electrically non-conductive material forming a boot that encloses the base of the rail where the rail passes over its support. This insulating boot extends upwardly on opposite sides of the rail web and outwardly therefrom to form long surface electrical creepage paths between the rail and the rail support that provide electrical isolation even when the entire assembly of rail, boot and rail support is wet with electrolyte.

6 Claims, 2 Drawing Figures

INSULATIVE PROTECTIVE DEVICE FOR RAIL FASTENER

BACKGROUND OF THE INVENTION

This invention relates to rail fastening devices for railway systems, and more particularly it relates to a protective device for electrically insulating a rail from its supporting structure.

Tracks or rails for modern rapid transit rail systems are generally fastened to a supporting structure by means of a plurality of spaced apart rail fasteners. Examples of such rail fasteners that have been used are described in U.S. Pat. No. 3,784,097 to Landis and U.S. Pat. No. 3,858,804 to Hixson. Both of these assemblies comprise a metal top plate which is fastened to the rail and a base plate separated from the top plate by a layer of elastomeric material to provide vibration isolation and a degree of electrical insulation, with the entire assembly being fastened to supporting structure such as a concrete bed.

Because rapid transit rails are used as electrical conductors for traction power current as well as for train speed command signals, it is necessary to provide and maintain electrical insulation between the rails and the rail support structure. The aforesaid rail fasteners presently in use do provide some electrical insulation between the rails and the rail support structure. However, heretofore, the surface creepage paths provided by the insulating elements of existing apparatus were found to be relatively short and easily contaminated with dirt and rail wear products. When these contaminated surfaces then become wet by fog, rain, or ground water, electrically conductive paths were formed over which electrical leakage currents flowed. Such leakage currents caused corrosion of the rail as well as of the metal parts of the rail fasteners and supports, resulting in further contamination of the surface creepage paths. This additional contamination of the creepage paths resulted in further reduction of the electrical resistance of the creepage paths and thence in larger magnitudes of leakage currents.

Such excessive leakage currents from train operation over poorly insulated rails caused destructive corrosion of rail, rail fasteners, rail support structures, metal tunnel liners, and other metallic structures. An excessively low rail-to-rail support structure resistance caused by such corrosion also tended to short out train speed command signals between the rails. In such a situation, the shorted section of track then appeared to the train speed command system as though it were occupied by a train, and train operation was disrupted.

To prevent loss of electrical train speed command signals and leakage of electrical traction currents over creepage paths, rail circuit insulation integrity must be maintained, and the rail fastener or support insulation must provide electrical insulation even when wet and contaminated with electrolyte. Therefore, the rail must be insulated from the rail fastener or support with electrical insulation means which provides relatively long surface creepage paths. Such long creepage paths will maximize the electrical leakage path resistance between rail and rail support even when the rail and the rail fastener or support apparatus are wet and contaminated with electrolyte.

In addition, the rail support insulating device must not interfere with the rail fastener's ability to securely fasten the rail relative to the support structure and to limit relative movement of the rail to within acceptable tolerances in the vertical, lateral, and longitudinal directions.

Accordingly, a general object of the present invention is to provide a rail insulating device that solves the aforesaid problems by electrically insulating rapid transit rails from their support structures.

Another object of the invention is to provide a device that reduces the flow of leakage current on a rail fastener for a rapid transit rail system, thereby greatly reducing corrosion and deterioration of the fastener and the rail.

Another object of the present invention is to provide a rail insulating device for electrically insulating rapid transit rails from their support structures that provides long surface electrical creepage paths for leakage current so that the device will maintain its electrical insulating properties when wet and contaminated with electrolyte.

Still another object of the present invention is to provide a rail insulating device that can be applied to any type of rail fastening method that clamps the rail in such a way that neither the rail hold-down assembly nor the rail lateral restraint device will make point contact against or penetrate the device.

Yet another object of the present invention is to provide a device for reducing the leakage current and thus the corrosion rate on a rail fastener which is relatively easy and economical to install on an existing rail fastener without requiring its modification or removal.

BRIEF SUMMARY OF THE INVENTION

In accordance with the invention, an insulating device for preventing the flow of leakage current is provided for use with rail fasteners such as the aforesaid Landis and Hixson fasteners which are adapted to secure the track rails to a concrete structure. The insulation device comprises an electrically non-conductive layer that encloses the base of the rail where the rail passes over the rail fastener or rail-tie support and then passes under the rail fastener hold-down clips, and then up along the rail base to the rail web, thence up along the rail web to fold back and form dual surface wings. The rail fastener insulating device must extend longitudinally along the rail on either side of and beyond the rail fastener or rail tie support. The device's electrical insulating layer is of a material that is tough enough to withstand the high compressive loads required to restrain the rail. The material for this insulating layer is also pliable enough so that the device can be opened up and clipped around the rail base. Yet it is also stiff enough to maintain its shape once in place. The rail-support insulating device has smooth, hard surfaces which must not be penetrated by the rail hold-down assembly or by the rail lateral restraint device. When installed, the railsupport insulating device is held in place by the clamping force exerted between the rail base and the rail fastener or rail tie support and by the clamping forces of the rail hold-down assembly.

One principal advantage of the present invention is that it provides a means for electrically insulating the rail from its support structures under conditions where the rail and rail supports are subject to wetting and contamination with electrolyte. This insulation is accomplished by means of long surface electrical creepage paths that are created by extending the insulating layer longitudinally along the rail on either side of the rail fastener or rail tie support and by extending the insulating layer vertically up the sides of the rail web and thence out to form dual-surface wings.

Another advantage of the present invention is that it provides a means for electrically insulating the rail from its support structure, whether a rail fastener or a rail tie, without modifying the support structure or hold down clips. This is accomplished by the insulating layer which encloses the base of the rail and passes between the rail and the rail support as well as between the rail and the rail hold-down clips.

Yet another advantage of the present invention is that it can be installed on existing rails by one man using ordinary tools. Once in place, both rail and fastener life will be extended because the device prevents corrosion caused by the flow of electrical current across the fastener.

Other objects, advantages and features of the invention will become apparent from the following detailed description of one embodiment thereof, presented in conjunction with the accompanying drawing.

DETAILED DESCRIPTION OF EMBODIMENT

Figure 1:
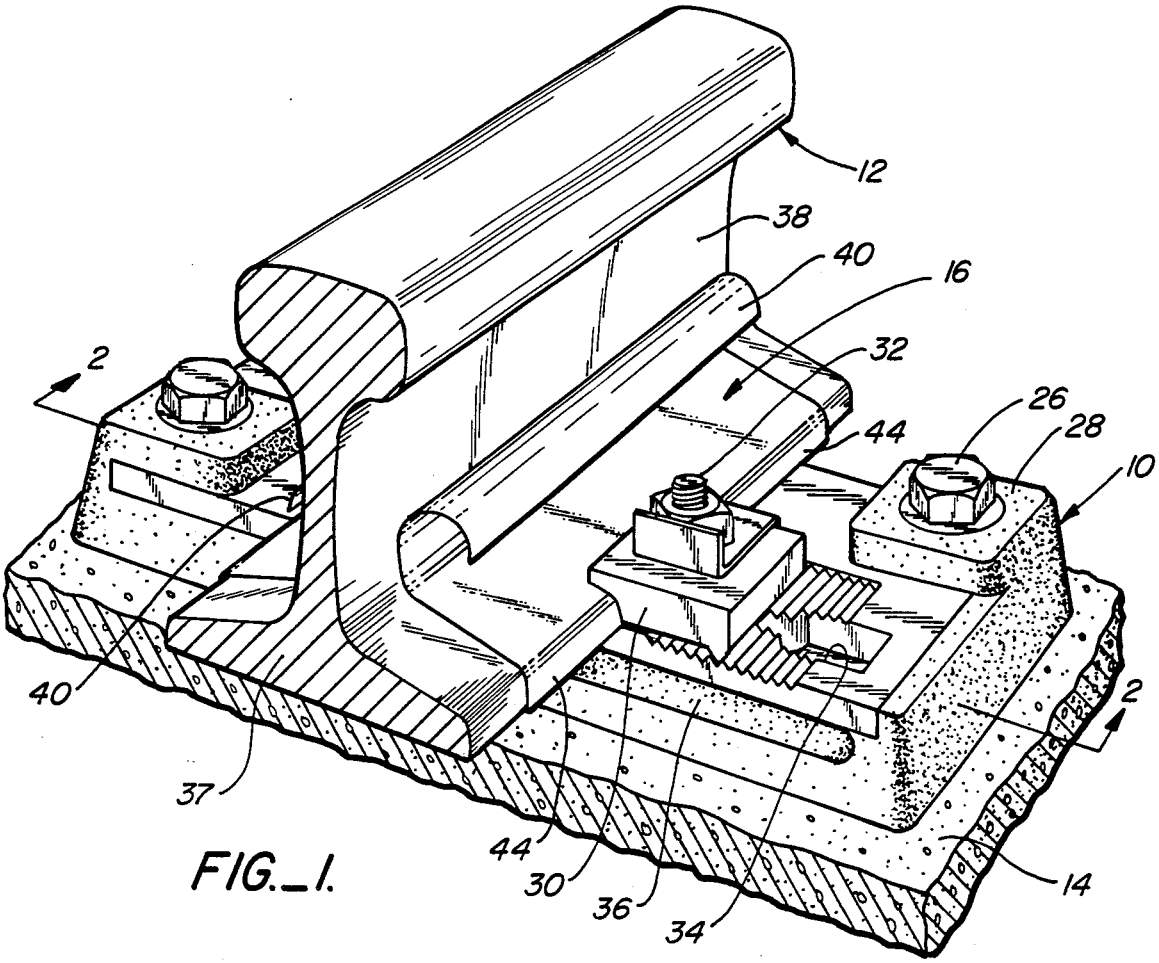
FIG. 1 is a view in perspective of a rail fastener installed with an insulating device according to the present invention.
Figure 2:
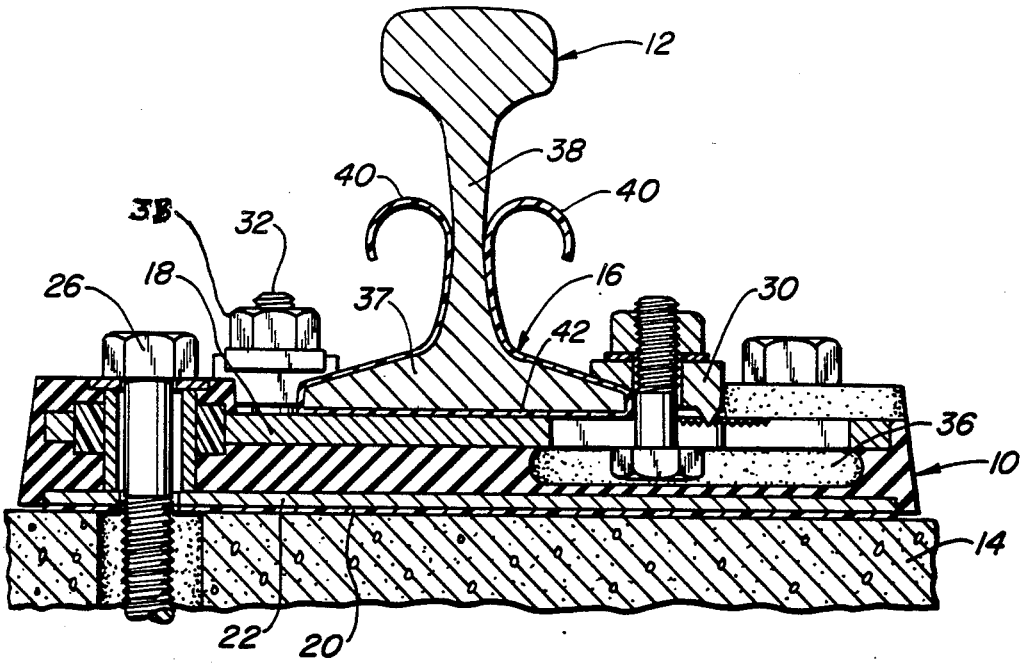
FIG. 2 is an end view in section of the rail fastener and insulating device shown in FIG. 1.

With reference to the drawing, FIGS. 1 and 2 show a typical rail fastener 10 as it appears when installed for directly affixing a rail 12 to a planar support structure 14 and having a protective insulating device 16 according to the present invention. Although the device 16 could be used on different forms of rail fasteners, for purposes of illustration, it is shown installed on a "Landis" type rail fastener which is described in U.S. Pat. No. 3,576,293. In general, this rail fastener, as shown in the drawing, comprises a rigid first or upper plate 18 and a base plate 20 separated by a layer 22 of elastomeric material. A pair of bolts 26 serve to secure the fastener to the supporting structure 14. These bolts are threaded into inserts (not shown) embedded in the concrete supporting structure. The head end of each bolt projects above an elastomeric or non-conductive boss portion 28 that protrudes above the upper side of the fastener.

A pair of clips 30 are each attached by a bolt 32 and a nut 33 to the upper plate 18 and serve to connect the fastener to the lower flanges of the rail. The lower end of the bolt extends below the upper plate through a slot 34 therein and into an aligned, enlarged cavity 36 formed within the rubber layer. The slot allows the clip and its bolt to be moved and adjusted into engagement with the rail flange before the bolt 32 and the nut 33 are tightened.

The protective insulating device 16 for the rail fastener 10, as shown in FIGS. 1 and 2, comprises a plastic insulating membrane that wraps around the base 37 of the rail 12. The device 16 is typically made of a suitable plastic sheet material such as polyester, nylon or polycarbonate film having a nominal uniform thickness (e.g. 14 mils). Other suitable non-reinforced or fiber-reinforced plastic materials which are capable of providing the desired load bearing, form holding, and electrical insulating characteristics could be used.

The device 16 is shaped to enclose the base 37 of the rail 12 under the rail clips 30 and to pass up along both sides of the rail web 38 to form two dual surface wings 40. As shown, these dual surface wings extend outwardly from the rail web for a substantial distance (e.g. 2 inches). In the embodiment shown, the top surface of each wing 40 is a maximum of four inches from the surface 42 on which the rail base 37 rests. The rail fastener insulating device 16 must extend longitudinally along the rail base 37 on either side of and beyond the rail fastener or rail-tie support 10. These longitudinal extensions 44 on either side of and beyond the edge of the rail fastener or rail-tie support 10 are of the order of 2 to 3 inches in length.

The rail support insulating device 16 must be composed of an electrically non-conductive membrane pliable enough to be opened and clipped around the rail, yet stiff enough to maintain its shape once installed in place. The electrically non-conductive membrane of the device 16 must be tough enough to withstand the high compressive loads required to restrain the rail. In addition, the insulating device 16 must have a smooth, hard surface that cannot be easily penetrated by the rail hold down assembly or by the rail lateral restraint device.

Although the rail support insulating device 16 is illustrated as having dual surface wings 40 of curved cross section, each dual surface wing may be of straight cross section angled down from the vertical surface toward the rail support surface 14 and providing, by its orientation, a lower surface protected from dirt and contamination.

Also, though the rail fastener insulating device 16 is illustrated as having longitudinal extensions on either side of and beyond the edge of the rail fastener of 2 to 3 inches parallel to the rail base 37, the dimension and slope of the surfaces may actually be varied to provide adequate surface creepage paths oriented so as to be protected from contamination.

As readily seen by reference to FIGS. 1 and 2, the extended length of the device 16 beyond the ends of the rail fastener, the fact that it extends under the rail between it and the fastener, and the outwardly extending wings from the rail web portion, all combine to increase the creepage paths for any leakage current to a degree that flow thereof is essentially eliminated. Hence, the rail fastener remains protected from the destructive effects of leakage currents by the device 16 which is relatively inexpensive and easy to install.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A rail-support insulating device for electrically insulating a track rail having a head, a web and a base flange from a rail fastener having clips for attaching said fastener to the rail and connected to a support structure, said device comprising:

an insulating membrane of electrically non-conductive sheet material passing beneath the base of the rail and extending beyond each edge of the rail-support fastener in the logitudinal direction of the rail, said membrane being wrapped around the base flange of the rail and beneath the rail clips of said fastener to insulate the rail from the clips and extending up along each side of the rail web in close contact therewith for a distance less than the full height of said rail web and to a point spaced below the rail head, the upper ends of said membrane extending outwardly from the rail web to form dual surface wing-like end portions on either side of the rail web free from contact with the rail head and any fastener structure, said wing-like end portions thereby providing high resistance surface barriers to potential paths of electrical current leakage from the rail to the rail fasteners or its support structure.

2. The insulating device as described in claim 1 wherein said membrane is a non-conductive plastic material.

3. The insulating device as described in claim 1 wherein said membrane is a plastic material having a thickness of around 14 mils.

4. The insulating device as described in claim 1 wherein said dual surface wings have a curved shaped in cross-section.

5. The insulating device as described in claim 1 wherein said dual surface wings extend outwardly from opposite sides of said track rail for a distance of around 2 inches.

6. The insulating device as described in claim 1 wherein both ends of said membrane extend beyond the end edges of said rail fastener by a distance of at least 2 to 3 inches.

* * * * *